US005551107A

United States Patent [19]

Graebe

[11] Patent Number: 5,551,107

[45] Date of Patent: Sep. 3, 1996

[54] MODULAR CUSHION CONSTRUCTION WITH DETACHABLE POMMEL, HAVING A COVER WITH FRONT AND REAR OPENINGS

[76] Inventor: Robert H. Graebe, 7 Persimmon Ridge Dr., Belleville, Ill. 62223

[21] Appl. No.: 554,541

[22] Filed: Nov. 7, 1995

Related U.S. Application Data

[60] Division of Ser. No. 334,601, Nov. 4, 1994, which is a continuation-in-part of Ser. No. 53,551, Apr. 27, 1993, abandoned, which is a continuation of Ser. No. 839,305, Feb. 20, 1992, abandoned.

[51] Int. Cl.[6] ..... A47C 27/10; A47C 7/02; A47G 9/00

[52] U.S. Cl. ..... 5/654; 5/653; 5/922; 297/467

[58] Field of Search ..... 5/653, 654, 481, 5/448, 455, 900.5, 490, 922, 470, 471; 297/467, 452.41, 452.25, 219.1, 452.61, DIG. 3

[56] References Cited

U.S. PATENT DOCUMENTS

| | | | |
|---|---|---|---|
| D. 335,235 | 5/1993 | Hildreth | 5/653 |
| 2,800,165 | 7/1957 | Talalay et al. . | |
| 2,970,638 | 2/1961 | Halter | 5/653 |
| 3,376,070 | 4/1968 | Johnson | 5/653 |
| 3,487,134 | 12/1969 | Burr | 297/452.61 |
| 3,542,421 | 11/1970 | Ambrose | 297/230 |
| 4,234,228 | 11/1980 | Flamm . | |
| 4,643,481 | 2/1987 | Saloff et al. | 5/653 |
| 4,753,480 | 6/1988 | Morell | 5/653 |
| 4,796,948 | 1/1989 | Paul et al. | 5/654 |
| 4,824,169 | 4/1989 | Jarrell | 297/230 |
| 5,018,790 | 5/1991 | Jay | 5/653 |
| 5,052,068 | 10/1991 | Graebe | 5/455 |
| 5,111,544 | 5/1992 | Graebe | 5/490 |
| 5,137,333 | 8/1992 | Chee | 297/458 |
| 5,149,173 | 9/1992 | Jay et al. | 297/284.9 |
| 5,152,023 | 10/1992 | Graebe | 5/654 |
| 5,163,737 | 11/1992 | Navach et al. | 5/653 |
| 5,211,446 | 5/1993 | Jay et al. | 297/444 |
| 5,272,780 | 12/1993 | Clute | 5/655 |
| 5,333,921 | 8/1994 | Dinsmoor, III | 297/219.1 |
| 5,352,023 | 10/1994 | Jay et al. | 5/653 |
| 5,369,828 | 12/1994 | Graebe | 5/654 |
| 5,378,045 | 1/1995 | Siekman et al. | 297/452.41 |

FOREIGN PATENT DOCUMENTS

| | | | |
|---|---|---|---|
| 721032 | 12/1954 | United Kingdom | 5/490 |

OTHER PUBLICATIONS

Tri–Max Information sheet D–8083 dated Jan. 1, 1989.

*Primary Examiner*—Alexander Grosz
*Attorney, Agent, or Firm*—Polster, Lieder, Woodruff & Lucchesi

[57] ABSTRACT

A modular cushion comprising a shaped base which has a flat rear portion having a substantially flat center area and a raised front portion with angularly directed valleys on each side, a removable pommel releasably secured to the flat center portion, a resilient pad positioned on the flat portion of the base to relieve pressure on the ischial and trochanters and a cover having a non-skid undersurface and two-way stretchable material covering a portion of the top. The cover has a front panel and a rear panel, with a large opening in the rear panel to allow the cover to be positioned over the base, and a smaller opening in the front panel aligned with the center portion of the base and with the pommel whereby the pommel can be inserted and removed through the opening by a person seated on the cushion, and a flap, including means for retaining the flap in closed position, hingedly connected to the front panel and shaped to cover said opening. The resilient pad preferably has an array of upstanding interconnected inflatable cells. The base is of porous cellular material and has a water impervious separate integral skin adhered over the top surface for strength and protection.

19 Claims, 4 Drawing Sheets

MODULAR CUSHION CONSTRUCTION WITH DETACHABLE POMMEL, HAVING A COVER WITH FRONT AND REAR OPENINGS

RELATION TO PRIOR APPLICATION

This application is a divisional of pending prior application Ser. No. 08/334,601, filed Nov. 4, 1994, entitled MODULAR CUSHION CONSTRUCTION WITH DETACHABLE POMMEL which is a continuation-in-part of Ser. No. 08/053,551, filed on Apr. 27, 1993 entitled MODULAR CUSHION CONSTRUCTION WITH FOAMED BASE (now abandoned) which is a continuation of Ser. No. 07/839,305 filed Feb. 20, 1992 entitled MODULAR CUSHION CONSTRUCTION WITH FOAMED BASE (now abandoned), and contains subject matter in common with Ser. No. 07/975,848, filed Nov. 13, 1992 entitled WATERBLOWN FOAM BASE (now U.S. Pat. No. 5,317,773) and Ser. No. 29/001,439 filed Nov. 13, 1992 entitled SEAT CUSHION (now U.S. Pat. No. Des. 342,911).

BACKGROUND OF THE INVENTION

This invention relates in general to cushions for seating and more particularly to a modular wheelchair cushion which has a shaped foam base, a fluid filled or foam cellular pad covering the rear part of the base, and a fabric cover enclosing the base and the pad.

Those who must spend extended time in wheelchairs run the risk of tissue breakdown and the development of pressure sores, which are extremely dangerous and difficult to cure. These pressure sores are decubitus ulcers, typically formed in areas where bony prominences exist, such as the ischia, heels, elbows, ears and shoulders. Typically, when sitting much of the individual's weight concentrates in the regions of the ischia, that is at the bony prominences of the buttocks and unless frequent movement occurs, the flow of blood to the skin tissue in these regions decreases to the point that the tissue breaks down. This problem is well known and many forms of cushions are especially designed for wheelchairs for reducing the concentration of weight in the region of the ischia, and these cushions generally seek to distribute the user's weight more uniformly over a larger area of the buttocks.

Another area where problems occur is in the trochanter area and both cushions and bases for the cushions are shaped so that the thighs are loaded and pressure is relieved on the ischia and the trochanters. Still another problem with wheelchair type cushions is stabilization of the user so that he has a feeling of security when sitting in the wheelchair.

I have a number of patents showing cellular cushions which comprise an array of closely spaced air cells which project upwardly from a common base and are interconnected. These cushions combine the most uniform distribution of weight and thus provide the greatest protection from the occurrence of pressure sores. Since the air cells communicate with each other, all exist at the same internal pressure and each air cell exerts essentially the same restoring force against the buttocks, irrespective of the extent to which it is deflected. U.S. Pat. No. 4,541,136 shows a cellular cushion currently manufactured and sold by Roho, Inc. of Belleville, Ill. for use on wheelchairs.

The stability problem has been attacked by the use of shaped bases, such as shown in Graebe U.S. Pat. Nos. 4,953,913, 5,317,773 and U.S. Pat. No. Des. 342,411 and Jay U.S. Pat. No. 4,726,624. These bases are generally used in injunction with cushions and Graebe U.S. Pat. No. 4,953,913 has been used in conjunction with a cellular cushion and a fabric cover. The stability problem also has been addressed in the cellular cushion field by the use of zoned areas of inflation as shown in Graebe U.S. Pat. No. 4,698,864 which shows a zoned cellular cushion with cells of varying height and Graebe U.S. Pat. No. 5,052,068 which shows another form of zoned cushions with cells of different heights.

Graebe U.S. Pat. No. 5,111,544 shows a cover for a zoned cellular cushion which keeps the cells from deflecting outwardly. This cover has a stretchable top, a skid resistant base and a non-stretchable fabric side panel area.

Patents which use a shaped base, i.e., my U.S. Pat. Nos. 4,963,913 and 5,317,773 and Jay U.S. Pat. No. 4,726,624 use a raised center pommel on the front of the base to direct the location of the legs of the user. However, the raised pommel can be uncomfortable and interferes with the ability of the user, particularly male users, to effect a slide transfer off the front of the cushion when exiting the wheelchair. The pommel also interferes with the ability of the user of the chair to sit on the front edge of the chair, e.g., while eating at a table or working at a desk.

Another problem with a raised fixed pommel is that the location and direction of the legs is fixed and cannot be adjusted to the needs of the user.

Accordingly one aspect of this invention is directed to a solution to the problem of a raised fixed center pommel on a relatively rigid base.

Another problem with foamed bases is the matter of balancing durability, weight, strength, softness, strength or rigidity, and porosity. It is desirable to have a strong durable base which is both light in weight, has a soft feel in desired areas, and still has a relatively fluid impervious surface so that it does not absorb urine or other body fluids and can be readily cleaned. This problem is of more with waterblown foam bases than it is with hydrofluoride blown foams.

Thus, another aspect of this invention is directed to a solution to the problem of providing a fluid impervious, readily cleanable skin on a shaped foamed polyurethane foam base to provide a composite which has the required durability, strength and soft feel.

The present invention resides in a foamed base having a flat rear area onto which may be fastened a variety of resilient pads, including those which have a shaped surface to conform to body shapes, preferably a pad formed with upstanding air inflatable cells. Preferably, the base has a slightly raised front section which has a flat center pommel area. The entire raised front section has a relatively flat top surface except for two angularly inclined slight depressions to accommodate the legs of the user. The transition between the flat rear area and the raised front area is a smooth gradual shape which provides a soft transition between the two areas. This base is designed so as to facilitate slide transfer of the user to and from the base. A removable pommel is provided and is attachable and detachable to the flat center area of the front section of the base to assist in positioning and locating the legs of the user with respect to the cushion. A fabric cover forms the outside of the composite cushion and has a portion of the top formed of stretchable material and the remainder of the top and sides formed of a slick non-stretchable fabric with a skid resistant base. The base by itself is useful by able bodied persons who have good tissue bulk around their legs, whereas disabled persons who do not have good thigh bulk benefit by having a fluid filled module, such as an inflated air module, or a suitable foam module installed on the rear area.

Another facet of this invention is a foam base having a soft blown foam body which is liquid permeable and a separate skin member adhered to the top surface thereof during the blowing process, with the skin being liquid impervious, durable and stretchable at room temperature. With the softer; less dense foam of this application (necessitated by the use of water based blowing agents), the foam cannot be made self-skinning as is the case with hydrofluoride gas blown polyurethane without making the bases more dense and thus undesirably heavy.

This invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

FIGS. 1 and 2 show the present invention except for the cover which is shown in FIGS. 5 and 10. The basic composite modular cushion 10 includes a foamed shaped base 11, a removable pommel 12, and a removable flexible inflatable cellular cushion 13 formed with upstanding inflatable air cells 14.

Figure 1:
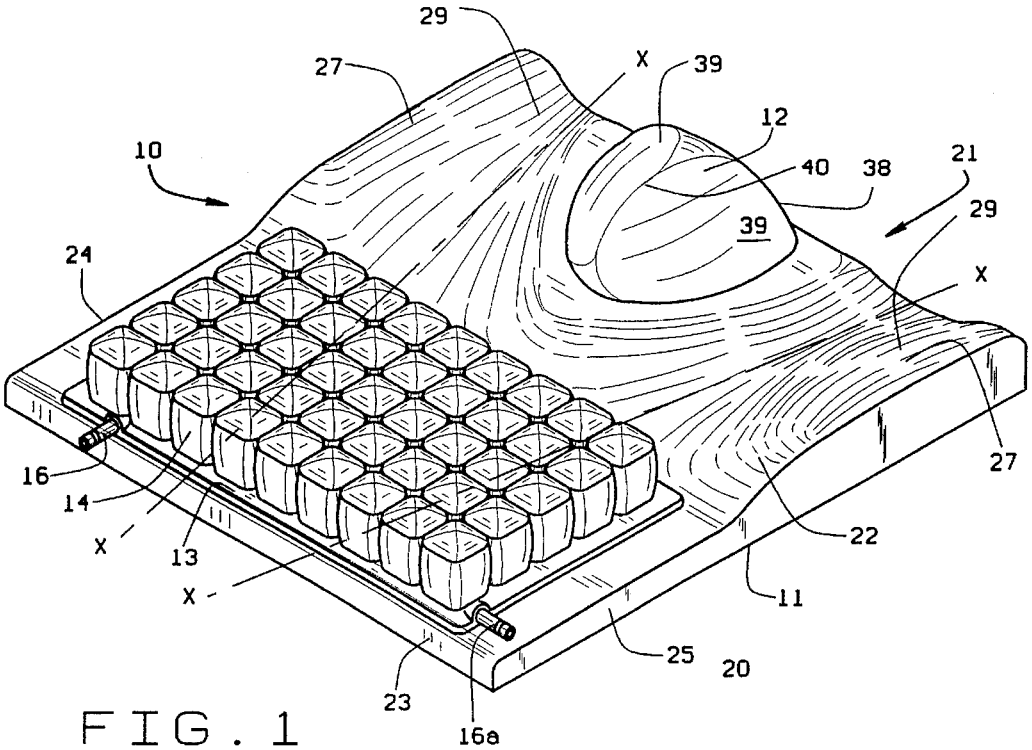
FIG. 1 is a front perspective view of the invention without a cover.
Figure 3:
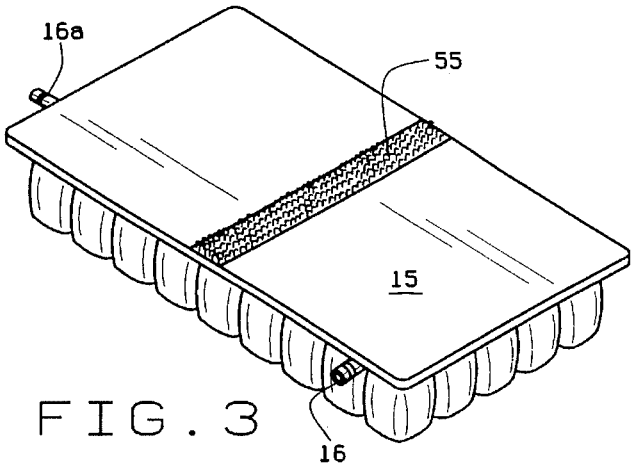
FIG. 3 is a bottom perspective view of the inflatable cushion.
Figure 4:
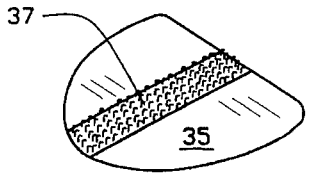
FIG. 4 is a bottom perspective of the removable pommel.

The base 11 comprises a substantially flat rear area 20 and a raised front area 21. A gently sloped or inclined connecting or transition area 22 connects the rear area 20 with the front area 21. The rear portion 20 extends from the back edge 23 to the inclined area 22 and substantially completely across the base from a first side edge 24 to the opposite or second side edge 25. The rear portion 20 is of substantially uniform thickness throughout.

The sloped transitional area 22 is a very complex curve such that the slope is relatively high at the edges 22*a*, 22*b* and the center 22*c*, which is directly behind the pommel 12. However, the slope of the transitional area 22 is much lower and less abrupt at the leg accommodating areas 22*d*, 22*e*.

Figure 2:
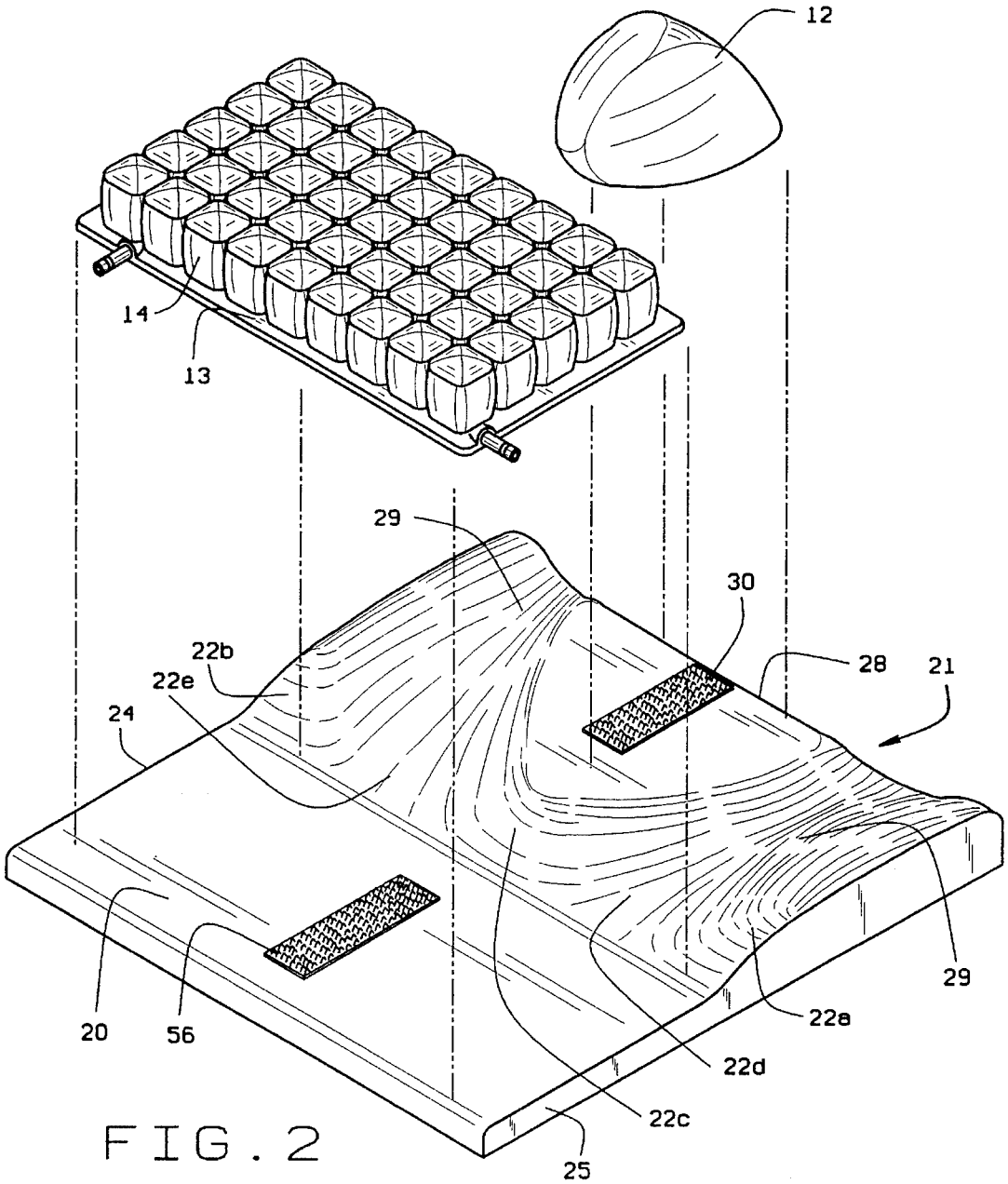
FIG. 2 is an exploded perspective view of the structure shown in FIG. 1.
Figure 6:
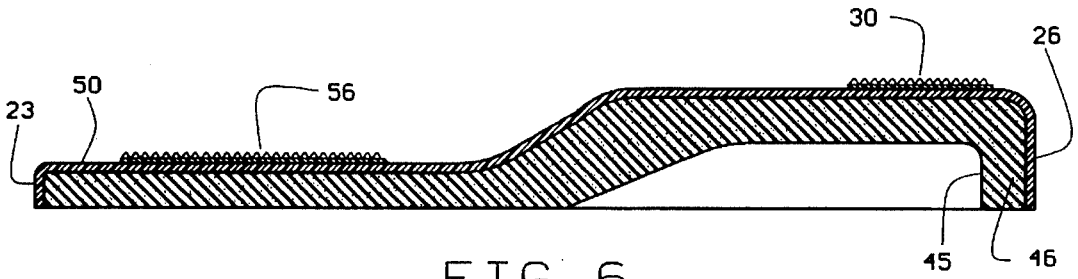
FIG. 6 is a vertical sectional view through the base.

The sloped connecting area 22 is designed to force support to the thighs, to relieve pressure to the ischial and the trochanters, and to provide a transition which minimizes deformation of the soft tissues of the user which are positioned above this part of the base. The base also includes a slightly tapered front face 26 as seen in FIG. 6 and inwardly curved thigh loading areas 27 at the side edges of the front 21. The areas 27 are sloped slightly inwardly from the outer side edges 24,25 to provide the proper thigh loading characteristics without providing too much pressure against the thighs. In the center of the front area 21 is a substantially flat center area 28 which is lower than the side areas 27 and is designed to help separate the legs, stabilize the pelvis, and to help keep the user from sliding out of his seat. Between the side areas 27 and the center area 28 are slightly depressed valleys 29 which are angularly inclined outwardly away from the rear base area 20 along the lines x—x in FIG. 2 so as to separate and properly position the legs of the user.

This outwardly inclination of the legs tends to retain the hip joints in place, especially with atrophied patients. As a patient's body astrophies, either from age or non-use, the muscles and tendons required to keep the hip joint together tend to waste away, and thus, with those patients most likely to require a wheelchair pad of this type, it is important that the legs be positioned as to urge the thigh bone into the hip socket and restrain the hip joint socket from being dislocated.

The curved thigh supporting areas 27 are sloped inwardly from the outer side edge to provide the proper thigh loading characteristics without causing too much pressure on the thighs.

The front area 21 thus has a substantially rectangular upper surface which is relatively flat, except for the slightly raised edges 27 and the slight leg retaining valleys 29. The front area 21 also is relatively of uniform thickness except for whatever relieved areas may be formed in the bottom to reduce weight, save cost, provide a softer feel, relieve pressure on the genitals of a male user, etc.

The purpose of the relatively flat upper surface for the frontal area 21 is to assist transfer of the user on and off the base 11. If there is a raised pommel and deeply depressed leg channels, the user is impeded in his efforts to perform a slide transfer on and off the base 11. This construction facilitates the ability of the user to effect such transfer without outside assistance.

The inclined transition area 22 which connects the flat rear surface 20 to the front portion top surface, provides a transition which minimizes deformation of the soft tissues of the user which are positioned above this part of the base 11. It also forces support to the thighs and relieves pressure to the ischia and trochanters.

Figure 7:
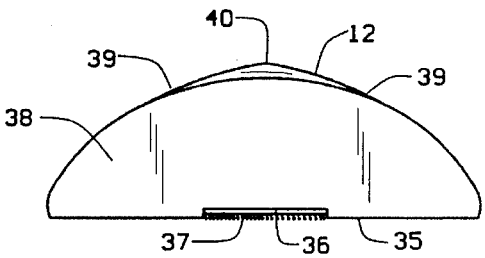
FIG. 7 is a front elevational view of the pommel.
Figure 8:
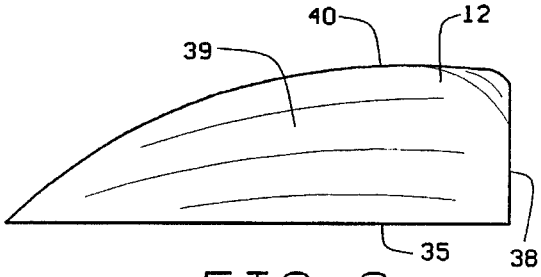
FIG. 8 is a side elevational view of the pommel.

A novel aspect of this invention is the provision of a detachable pommel 12. The pommel 12 has a flat bottom 35 which is provided with a longitudinal groove 36 into which is a fixed VELCRO hook and groove type fastener 37 (FIG. 7). The pommel 12 also has a slightly inclined front face 38 and inclined rearwardly sloped sides 39 which join in a top ridge 40.

The pommel 12 is used when it is necessary to separate the legs of the user, to stabilize the user's pelvis and helps keep the user from sliding out of the seat. With many patients, the pommel 12 is not necessary or need not be used at all times.

Different sizes and shapes of the pommel 12 can be used as desired or as necessary depending on the condition of the user.

Figure 9:
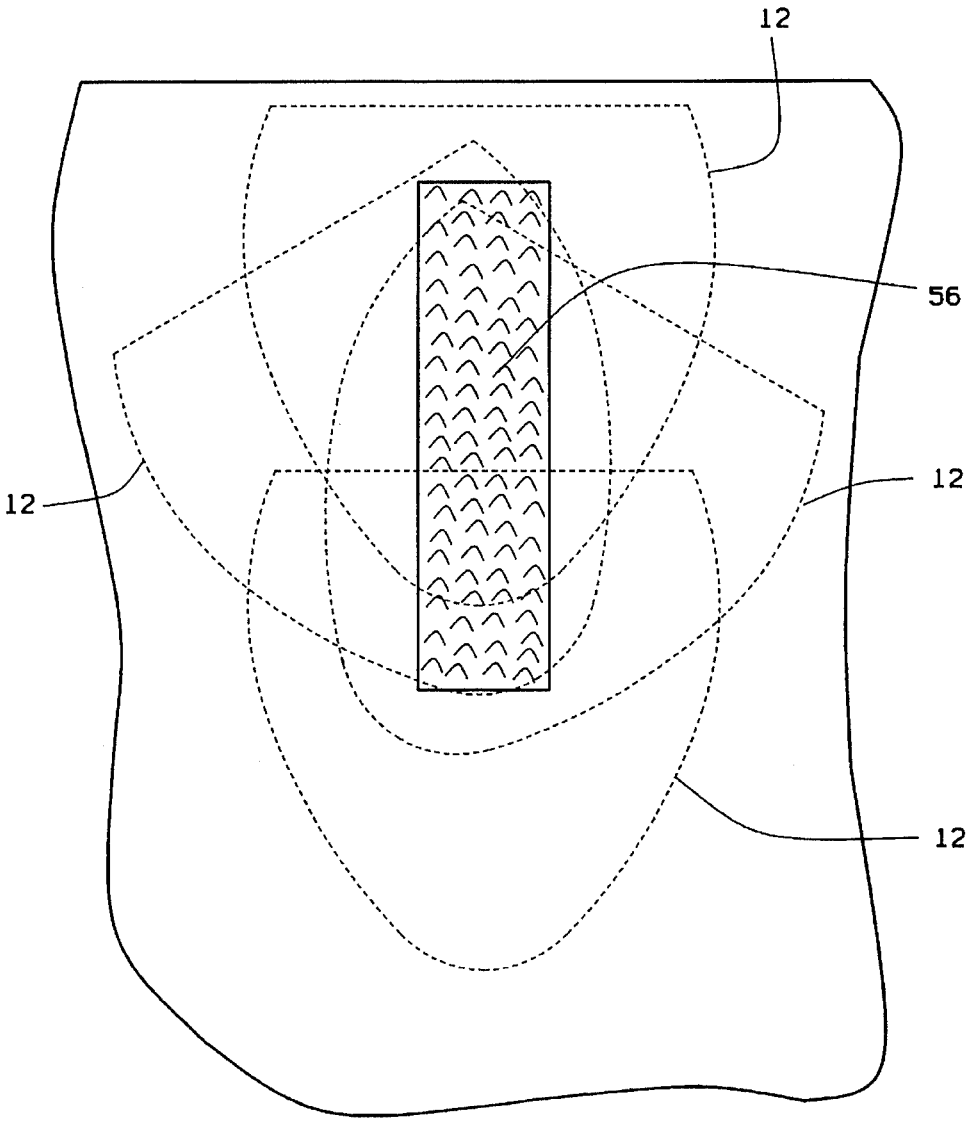
FIG. 9 is a fragmentary plan view of the pommel and base showing by broken lines different placements of the pommel.

The raised front area center portion 28 is relatively flat and a rectangular ribbon of VELCRO type hook and loop fastener 30 is adhered to the top area and is designed to engage the fastener 37 in the pommel 12 to removably secure the pommel 12 to the base 11. The location and angle of the pommel 12 with respect to the base 11 can be adjusted almost universally using this fastener system. This variation in pommel placement is shown by the broken lines in FIG. 9.

The underside of the cushion front area 21 has a hollowed out area or cavity 45 formed therein. The hollowed out center area 45 provides a softer feel for the user as well as providing some relief for the genitals of the male user. It also reduces the weight of the cushion. The sides of the hollowed out area 45 can be expanded to give a softer feel to the legs of the user.

The front wall 46 of the cavity 45 is of sufficient width to keep the front edge from buckling.

A unique aspect of this base 11 is the provision of a distinct skin 50 which is adhered to the top surface of the base 11 but is of different porosity from the base itself. The skin 50 is necessary because it provides a moisture impervious skin for the base which is of relatively porous structure.

As noted in my prior application Ser. No. 07/839,305, now abandoned and U.S. Pat. No. 5,317,773, hydrofluoride blown urethanes are self-skinning and are of relatively light weight for their strength. Conventional water blown urethane does not self-skin and therefore needs to be much denser, and thus of greater weight for a given size, to provide the same properties as urethane blown foam.

By forming the base with an adhered skin, I can make a water blown foam base of more porosity and hence less weight, while still obtaining the necessary properties of being resistant to moisture and chemicals.

My preferred method of making the base 11 is to lay the skin 50 into the mold and foam the urethane in place in the mold so the skin 50 adheres to the foamed base 11. The skin 50 is stretchable at room temperatures and is moisture impervious. It seals the foam cushion 11 and strengthens it. The skin 50 actually becomes an integral chemically bonded part of the base 11 during the foaming process.

On the other hand, the pommel 12 can be formed from a urethane which is denser and relatively self-skinning without adding undue weight to the cushion.

The inflatable cushion 13 has a VELCRO type hook and loop fastener 55 fastened to the center of its bottom 15. The cells 14 of the cushion 13 as shown are divided into a left and a right area filled respectively through fill tubes 16, **16*a***.

The flat rear area 20 of the base also is provided with a co-extensive VELCRO type hook and groove fastener 56 to removably attach the cellular cushion 13.

The base is adaptable for use with pads with upstanding air cells, such as those shown in Graebe U.S. Pat. No. 4,541,136, preinflated cells as shown in Graebe U.S. Pat. No. 5,152,023, and any of the pad variations shown in Ser. No. 07/839,305, now abandoned, the hollow dome shaped pads shown in Sias, et al. U.S. Pat. Nos. 4,673,305, 4,605,582 and U.S. Pat. No. Des. 294,212, "T-foam", and molded domes, or arch elements as shown in Graebe U.S. Pat. No. 4,713,854.

Figure 5:
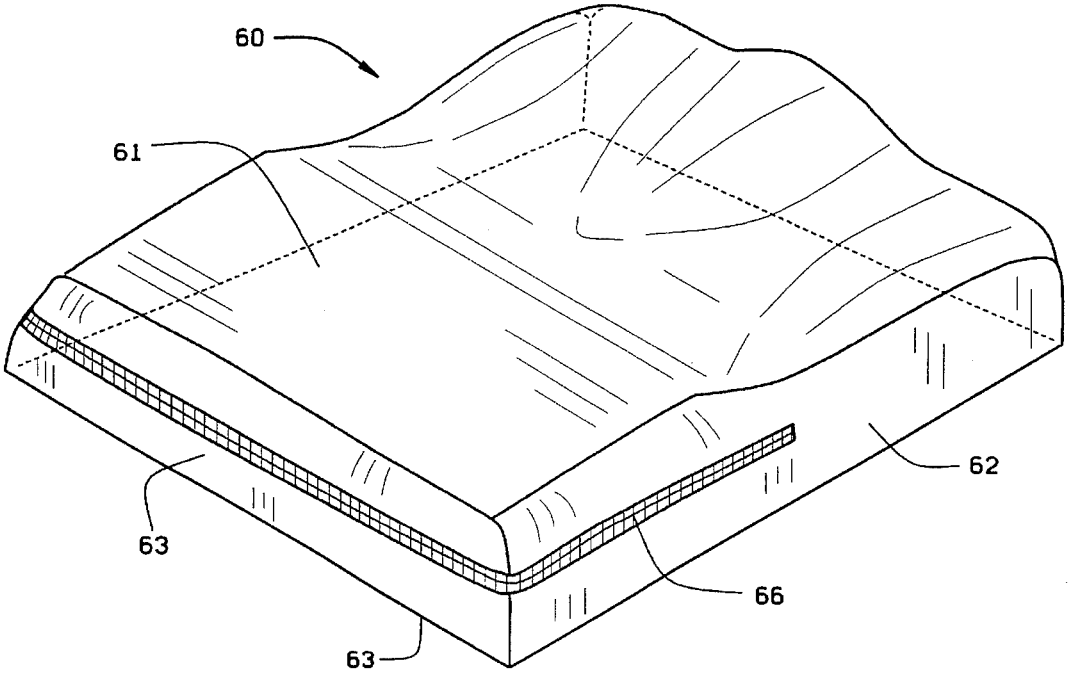
FIG. 5 is a perspective view of the cushion enclosed in a cover.
Figure 10:
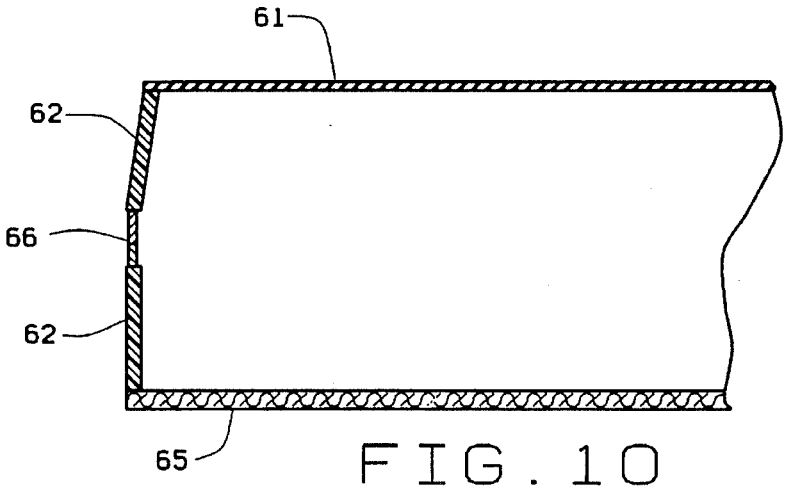
FIG. 10 is a fragmentary sectional view showing the details of the cover.

The cover 60 is shown in FIGS. 5 and 10 and includes a stretchable top panel 61, non-stretchable side, rear and front panels 62,63 and 64 respectively, and a skid resistant bottom panel 65. A zippered opening 66 allows insertion of the base 11, pommel 12 and cellular cushion 13 into the cover 60. The cover in general is similar to that shown in Graebe U.S. Pat. No. 5,111,544 which is incorporated herein by reference.

The side panels 62 generally are the shape of the side of the base 11. Similarly the front panel 64 and the rear panel 63 have the shape of the base front edge 26 and the rear edge 23, respectively.

Figure 11:
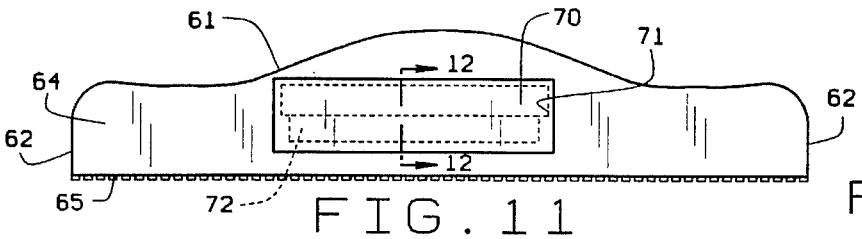
FIG. 11 is a front elevational view of the cushion shown in FIG. 5.
Figure 12:
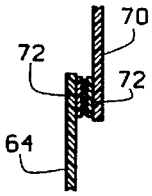
FIG. 12 is a fragmentary sectional view taken along line 12—12 of FIG. 11.

However, FIGS. 11 and 12 show in detail a part of the cover construction which is different from the cover of U.S. Pat. No. 5,111,544. This involves a flap 70 which is hinged to the front panel 64 and covers an opening 71 in the front panel 64 which allows the pommel 12 to be removed by a person sitting on the cushion 10. A VELCRO hook and loop fastener 72 is attached to the flap 70 and the front panel 64 where it defines the bottom of the opening 71 to lock the flap 70 in closed position. Alternatively, the flap 70 can be secured in closed position by a zipper or snaps, etc. The use of the flap 70 and opening 71 is optional, but is a preferred construction.

This invention is intended to cover all changes and modifications of the example of the invention herein chosen for purposes of the disclosure which do not constitute departures from the spirit and scope of the invention.

What is claimed is:

1. A substantially rectangular shaped base made from expanded foam having (a) a rear portion having an upper surface to accommodate the buttocks of a user, (b) a raised front portion having a top surface adapted to support a user, (c) a transition section connecting the rear portion and the raised front portion, (d) the top surface of the front portion having a substantially flat center area bounded by two slight leg depressions which retain and position the user without impeding slide transfer of the user on and off the base, and (e) a cover positioned over the base, said cover having an opening in the front panel aligned with the center area of the base, and a rear opening to allow the cover to be positioned over the base.

2. The cushion of claim 1 including a flap hingedly connected to the front panel and shaped to cover said opening.

3. The cushion of claim 2 including means for retaining the flap in closed position.

4. The cushion of claim 1 including a removable pommel member releasably attachable to the flat center portion.

5. The cushion of claim 1 wherein the rear portion of the base extends from the back edge of the base to the transition section and substantially completely across the base from side-to-side and has a substantially flat upper surface.

6. The cushion of claim 5 wherein the rear portion of the base is of substantially uniform thickness throughout.

7. The cushion of claim 6 including a resilient pad positioned on the substantially flat upper surface of the rear portion and means for fastening the pad to the base.

8. The cushion of claim 7 wherein the cover also is positioned over the resilient pad.

9. The cushion of claim 7 wherein the pad is an air inflatable cushion having areas of upstanding inflatable air cells.

10. The cushion of claim 4 wherein the pommel member is a substantially triangular member having a flat substantially triangular bottom surface, a substantially triangular front surface and two substantially triangular side surfaces which come together at one edge to define a ridge line from the front toward the transition portion of the base.

11. The cushion of claim 10 wherein the pommel member has a flat bottom surface which is provided with a slot and loop and hook fastener members positioned in the slot and wherein the flat center portion of the base has a corresponding loop and hook fastener member attached thereto.

12. The cushion of claim 1 wherein the base has a separate distinct surface skin member bonded to the top surface of said base, said surface member being moisture impervious and sealing the top surface of said base.

13. The cushion of claim 1 wherein the base has raised side edges on the front portion and the flat center portion is below the side edges to facilitate transfer of a user on and off the base.

14. The base of claim 1 including in combination a resilient pad positioned on the upper surface of the base rear portion and means for fastening the pad to the base.

15. The combination of claim 14 including a removable pommel member releasably attachable to the flat center area of the front portion of the base portion.

16. The combination of claim 15 wherein the cover has an opening in the front panel aligned with the center portion of the base and with the pommel whereby the pommel can be inserted and removed through the opening by a person seated on the cushion, and a flap is hingedly connected to the front panel and shaped to cover said opening.

17. The combination of claim 16 including means for retaining the flap in closed position.

18. The combination of claim 14 wherein the cover has an opening in the front panel aligned with the center portion of the base and a flap is hingedly connected to the front panel and shaped to cover said opening.

19. The combination of claim 18 including means for retaining the flap in closed position.

* * * * *